US007204612B2

(12) United States Patent
Wang et al.

(10) Patent No.: US 7,204,612 B2
(45) Date of Patent: Apr. 17, 2007

(54) HEAT DISSIPATION STRUCTURE FOR ELLIPSOIDAL LAMPS

(75) Inventors: Cheng Wang, Maio-Li County (TW); Wei-Cheng Lo, Miao-Li County (TW)

(73) Assignee: Coretronic Corporation, Miao-Li County (TW)

( * ) Notice: Subject to any disclaimer, the term of this patent is extended or adjusted under 35 U.S.C. 154(b) by 79 days.

(21) Appl. No.: 10/939,371

(22) Filed: Sep. 14, 2004

(65) Prior Publication Data

US 2006/0056181 A1 Mar. 16, 2006

(51) Int. Cl.
*F21V 29/00* (2006.01)

(52) U.S. Cl. ..... 362/264; 362/294; 362/373; 362/580

(58) Field of Classification Search ..... 362/345, 362/294, 298, 551, 560, 580, 547, 264, 373, 362/294.298
See application file for complete search history.

(56) References Cited

U.S. PATENT DOCUMENTS 4,405,882 A * 9/1983 Reinsch ..... 315/118
4,630,182 A * 12/1986 Moroi et al. ..... 362/294
6,142,659 A * 11/2000 Suzuki et al. ..... 362/560

* cited by examiner

*Primary Examiner*—Stephen F Husar
(74) *Attorney, Agent, or Firm*—Birch, Stewart, Kolasch & Birch, LLP

(57) ABSTRACT

A heat dissipation structure for an ellipsoidal lamp to provide an improved cooling effect for the ellipsoidal lamp has a redesigned shape and installing location for the blower duct that extends the outlet thereof to the edge of effective light beam zone of the ellipsoidal lamp so that the outlet is most close to the hot spots that require heat dissipation. Airflow ejected from the blower duct also is prevented from scattering to improve heat dissipation effect. The outlet may have a guiding plate located therein to channel the airflow close to the hot spots and match the shape of a reflection hood to improve airflow without scattering.

5 Claims, 4 Drawing Sheets

HEAT DISSIPATION STRUCTURE FOR ELLIPSOIDAL LAMPS

FIELD OF THE INVENTION

The present invention relates to a heat dissipation structure and particularly to a heat dissipation structure that provides cooling airflow to cool an ellipsoidal ultra-high pressure discharge lamp (UHP).

BACKGROUND OF THE INVENTION

Ellipsoidal UHPs can generate great brightness and high luminance, thus are widely used as the main lighting source on projectors or optical instruments. In general, the ellipsoidal lamp consists of a reflection hood 10 formed in a half-ellipsoidal shape and a burner 20 (Referring to FIGS. 1 and 2). The reflection hood 10 has a plated surface 11 (formed by a high reflective material) on one side facing the ellipsoidal focal point. The burner 20 is a UHP including a bulb 21 filled with mercury and inertial gases to generate a high pressure (about 180–250 atm.) when subject to arc discharge, two metal electrodes 22*b* and 22*a* (usually are tungsten electrodes) connecting respectively to a front foil 23 and a back foil 24 made of metal (usually molybdenum), and a leading wire 25 connecting to a tip wire 251 to couple with the front foil 23 to supply electricity. The interval of the two electrodes of the bulb 21 is located on the first focal point of the reflection hood 10. On the second focal point there is an integrated rod 26. Light emitting from the bulb 21 mostly are reflected by the plated surface 11 to the integrated rod 26 which allows the light focused on the second focal point to become uniform.

The bulb 21 is made from amorphous quartz glass durable to temperature about 1300° C. Temperature higher than that transforms the material of the bulb 21 to crystallized quartz glass and will result in decreasing of the glass transparency. And the temperature of the bulb 21 will increase and result in deformation and wall-thinning of the bulb 21 that will finally cause the bulb 21 to blast. The optimum operation temperature of the bulb 21 is about 850–950° C. At a temperature lower than that, mercury circulation in the bulb is not desirable and the bulb 21 will gradually darken, and the risk of blast also exists. Hence temperature control of the bulb 21 is very important. Uneven temperature will cause uneven thermal stress and result in blast or damage of the bulb 21. In general, the temperatures at a bulb top 211 and a bulb bottom 212 on two sides of the bulb 21 are used to determine whether the operation temperature is in the proper range. In addition, the electric connection points of the front foil 23 and the neighboring elements such as the tip wire 251 and a first connection point 252 also tend to oxidize under high temperature, and that also affects the life span of the UHP.

Therefore heat dissipation of the UHP is an important issue. A conventional heat dissipation method (referring to FIG. 2) is to channel heat dissipation airflow through a blower duct 30 to the hot spots that require cooling. The hot spots include the bulb top 211, and the electric connection points of the front foil 23 and the neighboring elements such as the tip wire 251 and the first connection point 252. To avoid blocking the reflection light reflected by the plated surface 11, the blower duct 30 is located on the periphery of the reflection hood 10 (especially a straight line-1 extended from the edge of the plated surface 11 along the light exit projecting direction) so that light gathering of the integrated rod 26 is not affected. Otherwise the blower duct 30 will block the reflection light from the plated surface 11 and affect the optical efficiency of the system.

The airflow for heat dissipation is provided by a blower 40. Due to the airflow poured out from the blower 40 is scattering, the blower duct 30 is provided to converge the airflow and direct the airflow to the hot spots of the burner 20 to disperse heat. Theoretically, the closer the blower duct 30 from the hot spots, the better the heat dissipation effect becomes. But the optical design requires to converge as mush of the reflection light from the reflection hood 10 to the integrated rod as possible, it is not desirable to have any thing blocking the light exit of the burner 20. Hence the airflow outlet of the conventional blower duct 30 is usually located on the outer side of the reflection hood 10 (referring to FIG. 3).

Due to the front end of the airflow outlet of the blower duct 30 is far away from the hot spots, the output airflow often cannot cover or concentrate on the entire burner 20. To resolve the heat dissipation problem of the bulb, the airflow volume of the blower 40 has to increase. In the high power projector (200W or more), the blower 40 generates a great noise even louder than the axial fan. Moreover, boosting the airflow volume of the blower 40 not only increases the noise of the system, increasing the rotational speed also affects the life span of the blower 40.

Furthermore, the conventional blower duct 30 is separated from the ellipsoidal lamp. Airflow leakage occurs between the blower duct 30 and the ellipsoidal lamp. This results in circulation of heated air and affects heat dissipation.

SUMMARY OF THE INVENTION

Therefore it is an object of the present invention to provide a heat dissipation structure to improve the cooling effect of ellipsoidal lamps.

Another object of the invention is to provide a heat dissipation structure for an ellipsoidal lamp that has the outlet of a blower duct extended to the edge of the effective light beam zone of the ellipsoidal lamp so that the outlet of the blower duct is close to the hot spots that require heat dissipation to avoid scattering of the heated air and improve heat dissipation effect.

Yet another object of the invention is to provide a heat dissipation structure for an ellipsoidal lamp that has a guiding plate located in the outlet of the blower duct to channel the cooling airflow close to the hot spots.

Still another object of the invention is to provide a heat dissipation structure for an ellipsoidal lamp that has the outlet of the blower duct connecting to the reflection hood to channel the airflow and prevent the airflow from scattering.

In order to achieve the foregoing objects, the heat dissipation structure of the invention aims to improve the cooling effect of the ellipsoidal lamp that has a redesigned shape and installation location for the blower duct such that the outlet of the blower duct is extended to the edge of effective light beam zone of the ellipsoidal lamp to make the outlet close to the hot spots that require heat dissipation to avoid scattering of the airflow ejected from the blower duct and improve heat dissipation effect.

In another embodiment of the invention the outlet of the blower duct has a guiding plate to channel the airflow to the nearest hot spots and also matches the shape of the reflection hood to achieve an improved airflow channeling effect to prevent the airflow from scattering.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
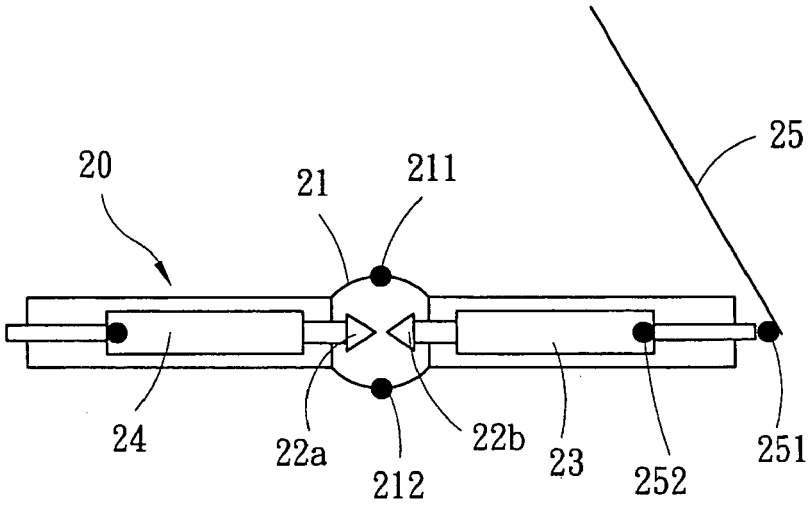
Fig.1 PRIOR ART
FIG. 1 is a schematic view of the basic structure of the burner of a conventional ellipsoidal lamp.
Figure 2:
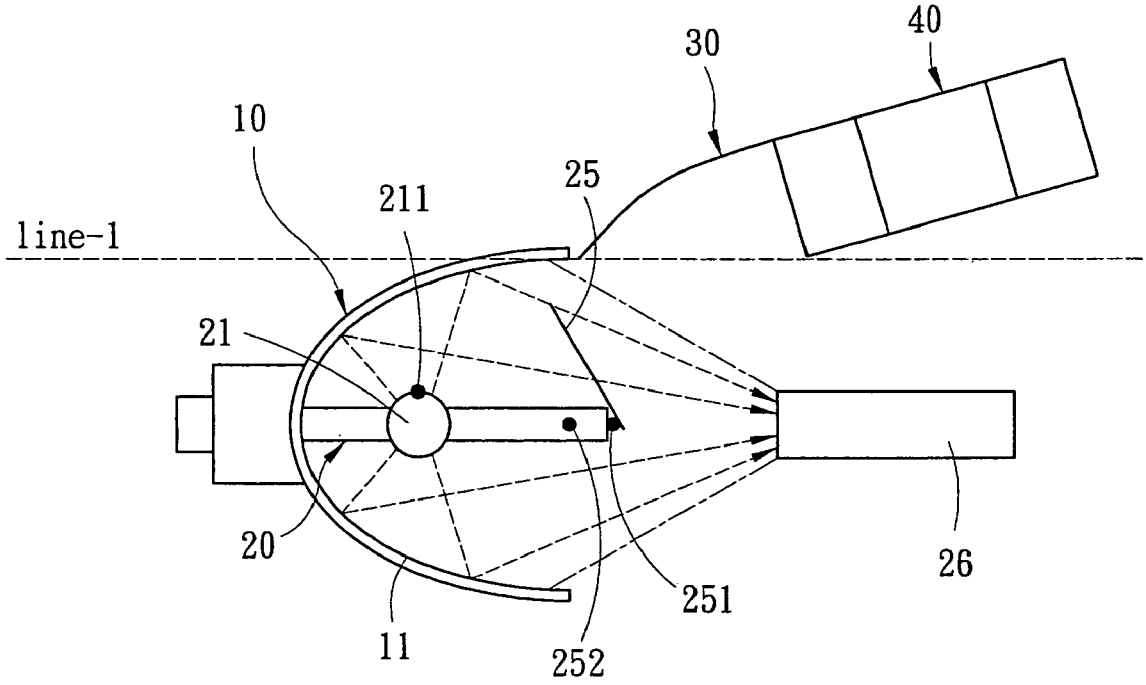
Fig.2 PRIOR ART
FIG. 2 is a schematic view of the basic structure of a conventional ellipsoidal lamp and the heat dissipation structure thereof.
Figure 3:
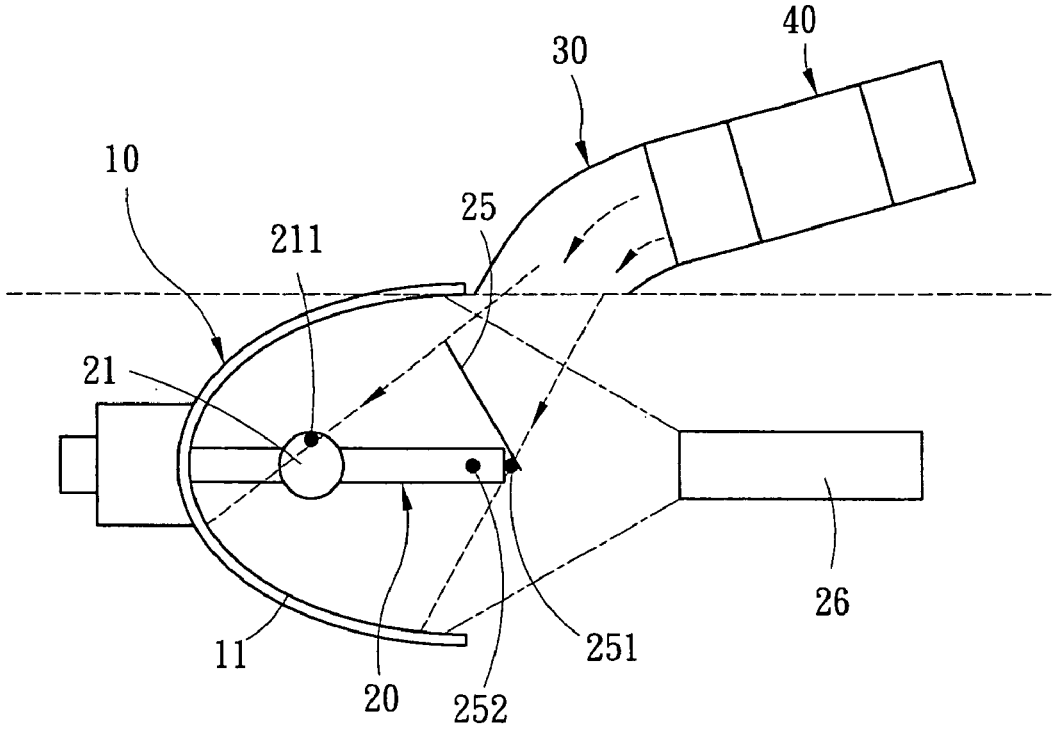
Fig.3 PRIOR ART
FIG. 3 is a schematic view of a conventional ellipsoidal lamp and the heat dissipation structure indicating the flow path of heat dissipation airflow.
Figure 4:
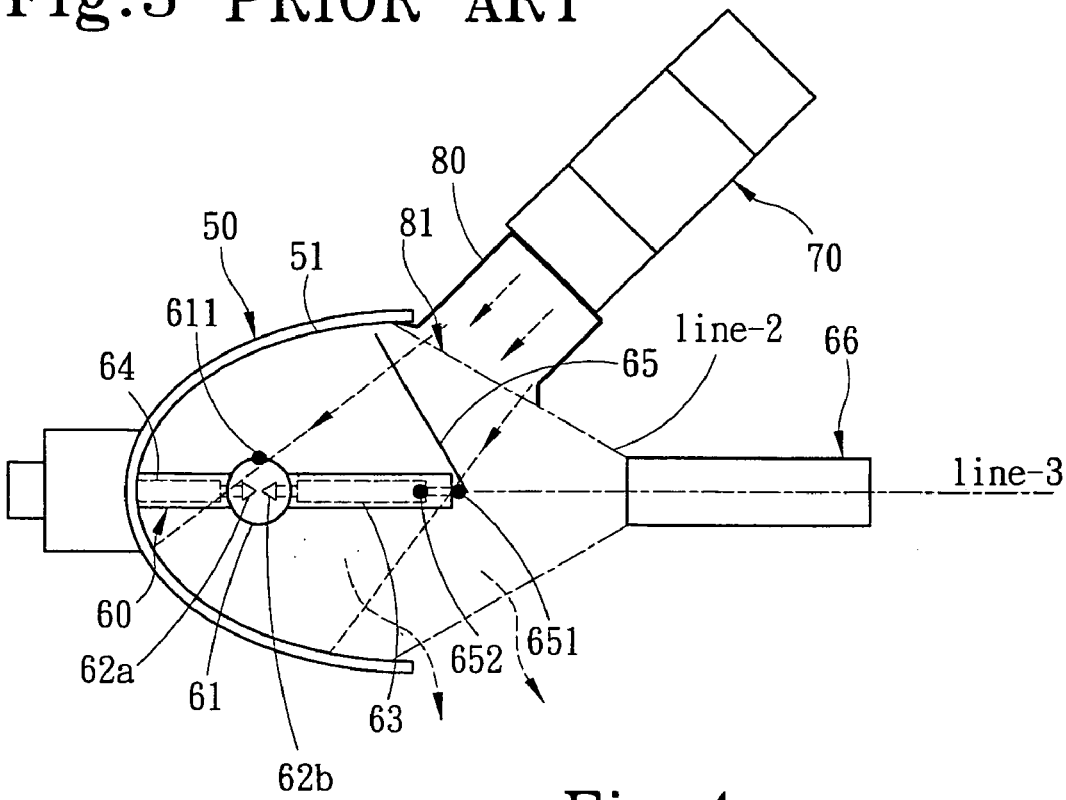
FIG. 4 is a schematic view of the invention showing the ellipsoidal lamp and the heat dissipation structure.

Please referring to FIG. 4, the present invention mainly targets the ellipsoidal lamps that are different from other ellipsoidal lamps which generate parallel projection light beams. The ellipsoidal lamp basically includes a reflection hood 50 which is a half-ellipsoidal element and has an inner side formed a plated surface 51 (formed by a high reflective material) facing the focal point to become a half-ellipsoidal reflection surface, a burner 60 including a bulb 61 which houses two electrodes 62*b* and 62*a* (usually are tungsten electrodes) that connect respectively to a front foil 63 and a back foil 64 made of metal, and a leading wire 65 connecting to a tip wire 651 to couple with the front foil 63 to supply electricity. The bulb 61 is located on a first focal point of the reflection hood 50. The reflection hood 50 has a second focal point around which an integrated rod 66 is located. Light emitting from the bulb 61 are mostly reflected by the plated surface 51 to the integrated rod 66 which allows the light focused on the second focal point to become uniform.

Refer to FIG. 4 for a first embodiment of the invention. The heat dissipation structure includes a blower 70 and a blower duct 80 coupling to the discharge exit of the blower 70. The blower duct 80 has an outlet 81 which has a conical or flat cross section. The outlet 81 is extended close to the edge of the effective light beam zone of the ellipsoidal lamp to be close to the hot spots that require heat dissipation to prevent heated airflow from scattering and improve heat dissipation effect. The effective light beam zone means an imaginative three dimension conical space formed by turning a connection line-2 about the axis line-3 of the half-ellipsoidal hood 50, where the connection line-2 is a straight line stretching from the edge of the plated surface 51 to the integrated rod 66. Hence the light reflects by the reflection surface of the reflection hood and escapes outside the three dimension conical space cannot project to the integrated rod and has no effect to the system brightness and is useless to the system, while the light within the conical space travels linearly and can project to the integrated rod.

Figure 5:
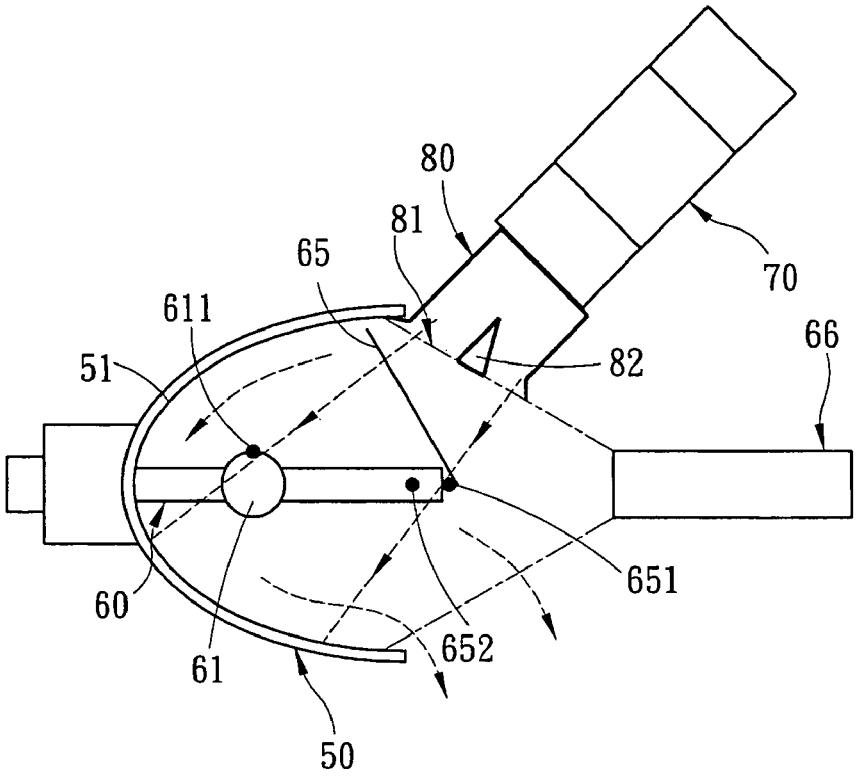
FIG. 5 is a schematic view of another embodiment of the present invention showing the guiding plate in the blower duct and the airflow direction.
Figure 6:
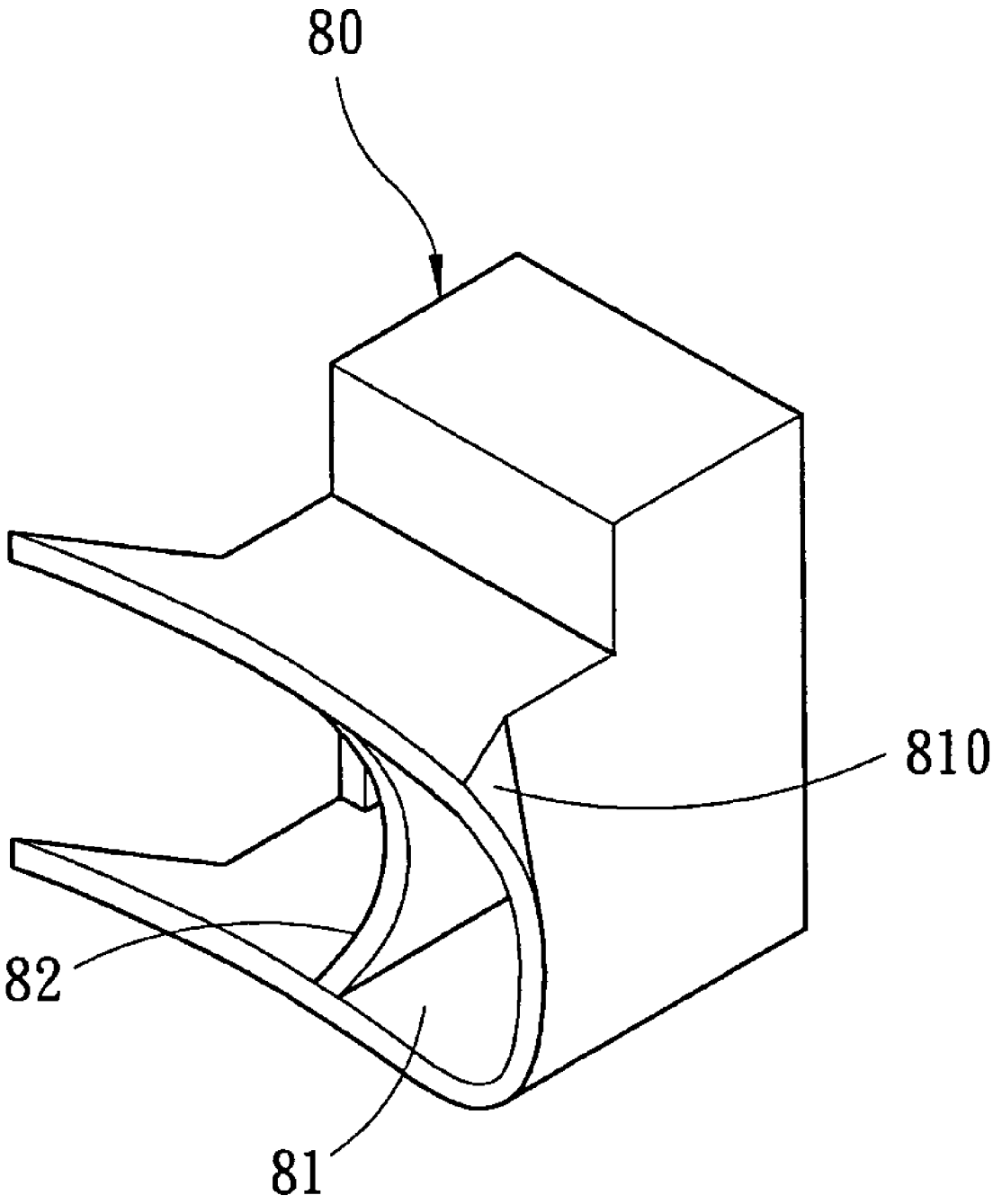
FIG. 6 is a perspective view of the blower duct.

Refer to FIGS. 5 and 6 for a second embodiment of the blower duct 80. It includes a guiding plate 82 located in the airflow path of the outlet 81 of the blower duct 80 to divide the heat dissipation airflow from the blower 70 and channel the heat dissipation airflow to the hot spots that require heat dissipation.

Figure 7:
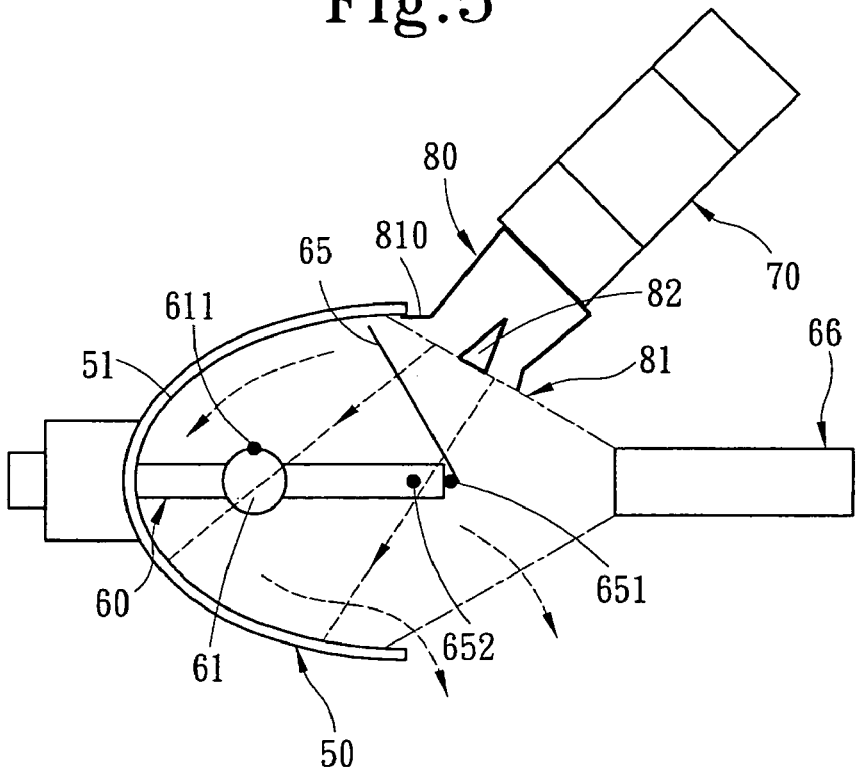
FIG. 7 is a schematic view of yet another embodiment of the present invention showing the blower duct outlet coupling with the ellipsoidal surface of the reflection hood.

Refer to FIG. 7 for a third embodiment of the invention. The outlet 81 of the blower duct 80 is connected to the reflection hood 50 so that the cooling airflow discharged from the outlet 81 can match the inner shape of the reflection hood 50 and be channeled to the bulb top 611 to achieve an improved airflow without scattering too early. The connection of the outlet 81 and the reflection hood 50 may be accomplished through a fastening means (such as screwing a bolt) on a coupling surface 810 formed on the edge of the reflection hood 50. By means of the coupling surface 810, an improved air tightness may be formed to prevent air leaking. The coupling surface 810 may adopt a continuous design along the ellipsoidal surface of the reflection hood 50 to enhance heat dissipation effect.

By means of the techniques of the invention set forth above, the following benefits may be achieved:

1. The outlet 81 of the blower duct 80 is closer to the hot spots that require heat dissipation. The hot spots include the bulb top 611 and electric connection points of the front foil 63 and the neighboring elements such as the tip wire 651 and the first connection point 652.

2. As the outlet 81 of the blower duct 80 is closer to the hot spots, scattering of the heat dissipation airflow may be reduced.

3. Utilization of the heat dissipation airflow increases. Hence a bulb of a given watts may be cooled under a comparatively lower airflow volume condition to improve the noise problem of the blower.

4. As the reflection hood and the blower duct are coupled tightly, they become integrated and can facilitate flowing of the heat dissipation airflow.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A heat dissipation structure for an ellipsoidal lamp comprising:

a half-ellipsoidal reflection hood having a plated ellipsoidal surface formed on an inner side facing a focal point thereof;

a burner located on a first focal point of the reflection hood; and an integrated rod located close to a second focal point of the reflection hood;

a blower and a blower duct coupled on an air discharge exit of the blower, the blower duct having an outlet extended along an edge of an effective light beam zone of the ellipsoidal lamp, the effective light beam zone being an imaginative three dimension conical space formed by turning a connection line about the axis of the half-ellipsoidal hood, where the connection line being a straight line stretching from the edge of the plated surface to the integrated rod.

2. The heat dissipation structure for an ellipsoidal lamp of claim 1, wherein the outlet of the blower duct has a coupling surface connecting to the ellipsoidal surface of the reflection hood and forming a continuous surface from the ellipsoidal surface.

3. The heat dissipation structure for an ellipsoidal lamp of claim 1, wherein the blower duct has a coupling surface connecting to the reflection hood through a fastening means to provide an improved air tightness without air leaking.

4. The heat dissipation structure for an ellipsoidal lamp of claim 1, wherein the outlet of the blower duct is conical or flat.

5. The heat dissipation structure for an ellipsoidal lamp comprising:

a half-ellipsoidal reflection hood having a plated ellipsoidal surface formed on an inner side facing a focal point thereof;

a burner located on a first focal point of the reflection hood; and an integrated rod located close to a second focal point of the reflection hood;

a blower and a blower duct coupled on an air discharge exit of the blower, the blower duct having an outlet extended close to along an edge of an effective light beam zone of the ellipsoidal lamp, the effective light beam zone being an imaginative three dimension conical space formed by turning a connection line about the axis of the half-ellipsoidal hood, where the connection line being a straight line stretching from the edge of the plated surface to the integrated rod; and a guiding plate located in the outlet of the blower duct to divide heat dissipation airflow generated by the blower to cool hot spots that require heat dissipation.

* * * * *